US005802416A

United States Patent [19]

Earle et al.

[11] Patent Number: 5,802,416

[45] Date of Patent: Sep. 1, 1998

[54] PHOTOGRAPHIC PROCESSING APPARATUS

[75] Inventors: Anthony Earle, Middlesex; Leslie Wells, London, both of England

[73] Assignee: Eastman Kodak Company, Rochester, N.Y.

[21] Appl. No.: 881,834

[22] Filed: Jun. 25, 1997

[51] Int. Cl.[6] ..... G03D 3/06

[52] U.S. Cl. ..... 396/578; 396/626; 396/630; 396/631

[58] Field of Search ..... 396/622, 624, 396/626, 630, 631, 633, 578; 134/64 P, 122 P

[56] References Cited

U.S. PATENT DOCUMENTS

| | | | |
|---|---|---|---|
| 3,911,460 | 10/1975 | Lasky et al. . | |
| 4,265,431 | 5/1981 | Falomo . | |
| 4,451,132 | 5/1984 | Kishimoto | 396/630 |
| 4,719,173 | 1/1988 | Hahm | 396/626 |
| 5,302,995 | 4/1994 | Hayashi . | |
| 5,307,107 | 4/1994 | Nozawa et al. . | |
| 5,416,551 | 5/1995 | Ishikawa et al. | 396/626 |

FOREIGN PATENT DOCUMENTS 0 649 058 A1 4/1995 European Pat. Off. .

*Primary Examiner*—A. A. Mathews
*Attorney, Agent, or Firm*—Frank Pincelli; David A. Novais

[57] ABSTRACT

Described herein is a countercurrent multi-tank washing stage (10) for photographic processing apparatus which comprises a first washing tank (500), a last washing tank (100) and at least one intermediate washing tank (200, 300, 400), each washing tank having a recirculation system (102, 202, 302, 402, 502) associated therewith. The first washing tank (500) is positioned upstream from the last washing tank (100). Each of the last washing tank (100) and the intermediate washing tanks (200, 300, 400) is fluidly connected to the recirculation system of an adjacent upstream washing tank (200, 300, 400, 500). Level sensors (112, 114, 212, 214, 312, 314, 412, 414, 512) are provided in each of the washing tanks (100, 200, 300, 400, 500) to control an operating level (116, 216, 316, 416, 516) of washing solution in each of the tanks (100, 200, 300, 400, 500) and a fill level (118, 218, 318, 418) in the last and intermediate tanks (100, 200, 300, 400). Fresh washing solution is added to the last washing tank (100) in response to signals from the level sensors (112, 212, 312, 412, 512) when the operating level falls below the level. Sensors (114, 214, 314, 414) at the fill level (118, 218, 318, 418) are used to control the transfer of solution from the last washing tank (100) via the recirculation systems (102, 202, 302, 402) to the tank(s) where the operating level has fallen. Sensors (110, 210, 310, 410, 510) are also provided in the recirculation systems (102, 202, 302, 402, 502) for sensing the conductivity of the washing solution and hence controlling the filling of the tanks (100, 200, 300, 400, 500) in response to conductivity values over a predetermined limit.

3 Claims, 1 Drawing Sheet

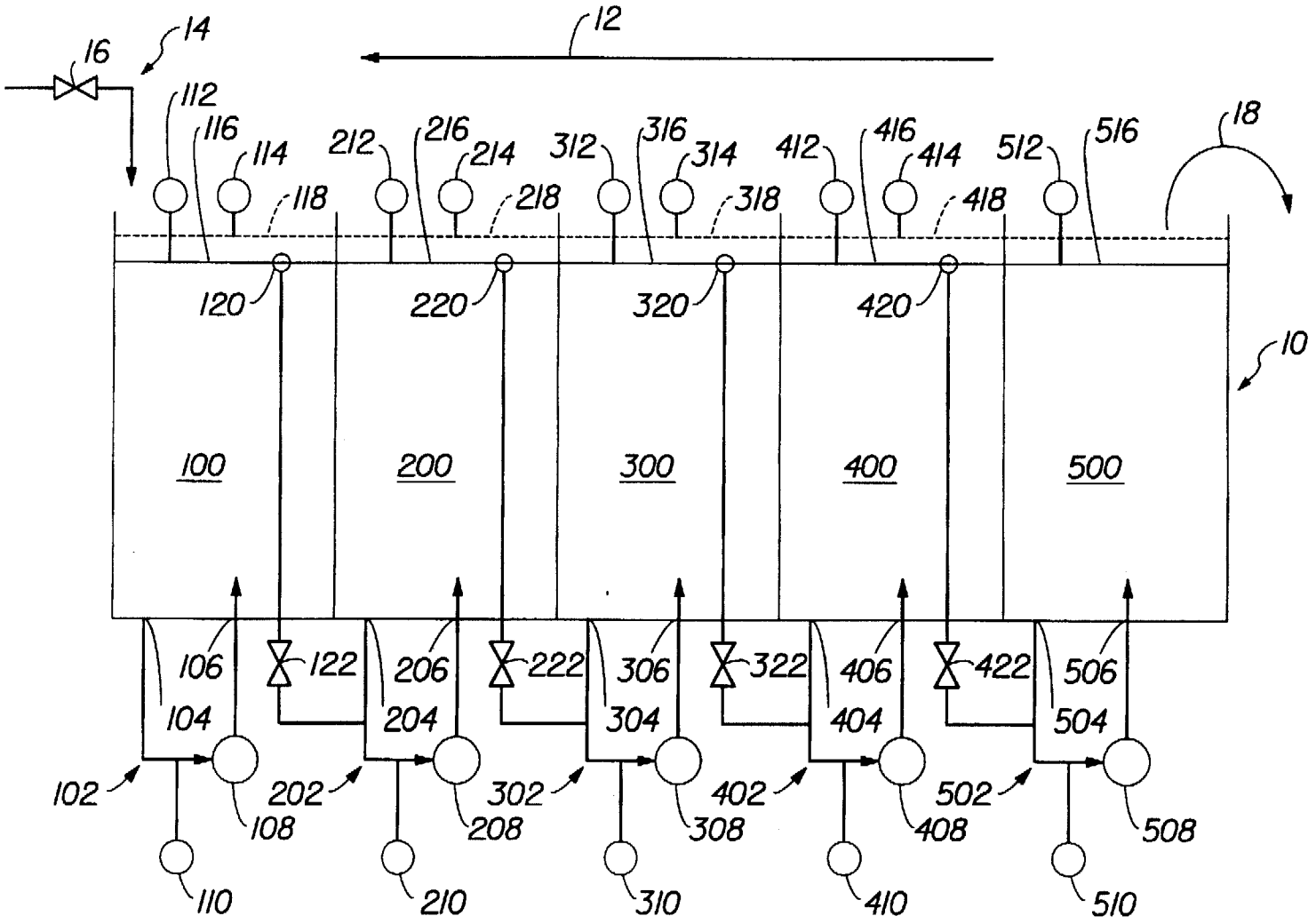
10
12
14
16
18
100
200
300
400
500
102
104
106
108
110
112
114
116
118
120
122
202
204
206
208
210
212
214
216
218
220
222
302
304
306
308
310
312
314
316
318
320
322
402
404
406
408
410
412
414
416
418
420
422
502
504
506
508
510
512
516

PHOTOGRAPHIC PROCESSING APPARATUS

FIELD OF THE INVENTION

The present invention relates to photographic processing apparatus and is more particularly concerned with washing/stabilizing arrangements for use in such apparatus.

BACKGROUND OF THE INVENTION

In large processing machines, one or more continuous leader belts are provided for transporting the photographic material to be processed, for example, photographic paper, along a processing path through the machine. These leader belts are located to one side of the processing path so as not to interfere with the movement of the photographic material along the processing path. The leading end of the paper or other photographic material to be processed is attached to the moving leader belt by means of a metal clip. The clip is attached to the belt, as it is moving, so that it is transported therewith, the paper or photographic material having been already threaded through the clip.

In such large processing machines, it is known to use a washing stage for washing photographic material in two sections, namely, a "high" flow section and a "low" flow section. The "high" flow section has a large volume of water flowing through it so that the dilution effect is sufficiently large to ensure that a photographic product is adequately washed. The "low" flow section is located after the bleaching and fixing stages. Here, the solution flow is minimized so that the high levels of silver which are washed out of the photographic product in the first stages of washing can be removed for silver recovery. This also reduces the environmental effects to an acceptable level when the used wash water is put to drain.

In order to achieve acceptable environmental levels, some processing machines employ countercurrent flow in the washing stage. This is very common in the so called "minilabs", and the effect of this countercurrent system is to reduce the amount of wash water required to give acceptable washing. Countercurrent washing systems have been extended to large processing machines which have been modified to use less processing solutions and wash water to reduce the water flow. In such countercurrent systems, the washing stage comprises a series of wash tanks arranged for countercurrent flow, that is, the flow of water through the wash tanks is in the opposite direction to the movement of the photographic material through those wash tanks. In such a washing stage, the individual wash tanks are arranged so that the level of wash water in different in each tank, the level decreasing from one tank to the next. This means that the last tank of the series, the cleanest, has the highest water level and the first tank in the series, the dirtiest, the lowest water level, the water overflowing from the one tank to the next to maintain this difference in water height, and maintaining a "cleanliness" gradient from the last tank to the first.

With the recent trend to reduce the amount of processing solution used when processing photographic material and also the amount of washing water utilized, large processing machines, of the type described above, have been adapted to operate with lower volumes of processing solution. In order to obtain the lower volumes, the width of the processing tanks in such machines need to be substantially reduced so that the material passes through a narrow processing channel which defines the processing path. This means that there is an unacceptably large difference in head height from the first tank in the series to the last which cannot be accommodated without compromising the overall wash time for the process.

If the difference in levels is maintained at relatively low, that is, there are small head heights in each tank, water could flow in the wrong direction causing waves to be formed in the wash water and, more importantly, contaminating the wash water in a cleaner wash tank.

Moreover, by allowing a recirculation pump in a previous wash tank to draw water therefrom encourages the ingress of air and foaming of the wash water may result. Non-return valves of various types have been utilized to overcome this problem, but they have a tendency to stick and restrict the flow.

In particular, for processing machines having reduced processing solution volumes, there is no space available to accommodate such devices on the wash water tanks.

SUMMARY OF THE INVENTION

It is, therefore, an object of the present invention to provide an improved washing/stabilizing arrangement for multi-strand processing machines which overcomes the problems mentioned above.

In accordance with one aspect of the present invention, there is provided a countercurrent multi-stage washing stage for photographic processing apparatus, the washing stage comprising:

a plurality of washing tanks having at least a first washing tank and a last washing tank with intermediate washing tanks located between the first and the last tanks, the first washing tank being upstream from the last and intermediate washing tanks, each washing tank having a recirculation system for circulating the washing solution therethrough;

an inlet through which fresh washing solution is added to the last tank of the washing stage;

an outlet from which washing solution is overflowed out of the first tank of the washing stage;

means for providing fluid connection between each washing tank and its adjacent upstream washing tank;

level sensing means for sensing a first level of washing solution in each of the washing tanks; and control means for receiving an output signal from the level sensing means for controlling the level of washing solution in each washing tank and also for controlling the recirculation system of each washing tank;

characterized in that the last and each intermediate washing tank further includes an outlet port therein, the outlet port being connectable to the recirculation system of an adjacent upstream washing tank via valve means, and further level sensing means for sensing a second level of washing solution which is greater than the first level and providing a control signal for the valve means via the control means when the second level has been sensed to reduce the level of the washing solution to the first level.

Preferably, each recirculating system includes a conductivity sensor for sensing the conductivity of the washing solution in that washing tank.

In accordance with a second aspect of the present invention, there is provided a method of controlling a countercurrent multi-tank washing stage comprising at least a first washing and a last washing tank with at least one intermediate washing tank therebetween, the first washing tank being upstream from the last and intermediate washing tanks, the method comprising the steps of:

a) controlling the recirculation of washing solution in each of the washing tanks;

b) sensing the conductivity of the washing solution in each of the processing tanks;

c) sensing the level of washing solution in each of the washing tanks;

d) replenishing the washing solution in the washing stage when the level of washing solution has dropped below a first level and/or the conductivity of the washing solution exceeds a predetermined limit in any one of the washing tanks;

characterized in that step d) further comprises the steps of:

e) adding fresh washing solution to the last washing tank until the washing solution reaches a second level, the second level being greater than the first level;

f) removing washing solution above the first level from the last washing tank and adding it to the recirculation system of an adjacent upstream intermediate tank until the washing solution in that tank reaches the second level; and g) repeating step f) for each intermediate tank until the first tank is filled to an overflowing level which is greater than the first level and the level of washing solution in every other washing tank is at the first level and the conductivity of the washing solution in each of the washing tanks below the predetermined limit.

In accordance with the present invention, contamination of the wash water is eliminated as the wash water can only flow one way under the control of the recirculation system of the next tank. Foaming is also eliminated, and the amount of the water required for washing is substantially reduced.

By using the arrangement in accordance with the present invention, wash water levels in each of the tanks of a multi-tank washing stage can accurately be controlled. This can be achieve by using one or more sensors for each wash tank.

BRIEF DESCRIPTION OF THE DRAWINGS

For a better understanding of the present invention, reference will now be made, by way of example only, to the accompanying drawing, the single FIGURE of which is a schematic illustration of a counter current washing system in accordance with the present invention.

DETAILED DESCRIPTION OF THE INVENTION

In the FIGURE, a washing stage 10 in accordance with the present invention is shown. The washing stage 10 comprises five wash tanks 100,200,300,400,500 located adjacent one another. Each tank 100,200,300,400,500 has a recirculation system 102,202,302,402,502 associated with it, each recirculation system 102,202,302,402,502 including an outlet 104,204,304,404,504 from the appropriate tank 100,200,300,400,500, an inlet 106,206,306,406,506 through which wash water is returned to the tank, and a pump 108,208,308,408,508.

Additionally, each recirculation system 102,202,302,402,502 includes a sensor 110,210,310,410,510 for sensing the conductivity of the water in each tank 100,200,300,400,500. This provides a measurement of the salt content of the water in each tank 100,200,300,400,500 and hence an indication of how clean the water is in that tank. The operation of these sensors 110,210,310,410,510 will be described in more detail later.

Each tank 100,200,300,400,500 also includes two level sensors 112,114,212,214,312,314,412,414,512 as shown. Level sensors 112,212,312,412,512 sense the normal operating level of the wash water in each tank 100,200,300,400,500 as indicated by the solid lines designated 116,216,316,416,516. Level sensors 114,214,314,414 sense a maximum level, indicated by the dotted lines designated 118,218,318,418, to which each tank 100,200,300,400 can be filled. Tank 500 can also be filled to a maximum level as indicated by dotted line 518, but there is no associated level sensor.

A further outlet 120,220,320,420 is provided each tank 100,200,300,400, at each tank's normal operating level 116,216,316,416, through which water can be removed to bring the level down from the maximum level 118,218,318,418 to the normal working level 116,216,316,416. Each outlet 120,220,320,420 is connected to the recirculation system 202,302,402,502 of an adjacent tank 200,300,400,500 which lies in the direction opposite to that in which the material being washed, that is, the next adjacent tank to the right of the particular tank in question, arrow 12 indicating the direction of travel of the material being washed (not shown) through the washing stage 10. Each outlet 120,220,320,420 is connected to the appropriate recirculation system 202,303,402,502 by means of a solenoid operated valve 122,222,322,422, as shown, which is controlled by control means (not shown) for the photographic processor of which the washing stage 10 forms a part.

Although outlets 120,220,320,420 have been described as being at the normal working level 116,216,316,416 of tanks 100,200,300,400, it will readily be appreciated that they can also be located at any suitable position below that level.

As the flow of wash water through the washing stage 10 is opposite to that indicated by arrow 12, fresh water is added to tank 100 through wash water inlet 14 which is controlled by a further solenoid operated valve 16. Water is transferred from tank 100 to tank 200 via recirculation system 202, from tank 200 to tank 300 via recirculation system 302, from tank 300 to tank 400 via recirculation system 402, from tank 400 to tank 500 via recirculation system 502, and then overflowed at wash water outlet 18.

In normal operation of the washing stage 10 of the processor, water is recirculated around each tank 100,200,300,400,500 by the associated recirculation system 102,202,302,402,502.

When level sensors 112,212,312,412,512 detect that the water level in one or more of the five tanks is too low, that is, the water level falls below the operating level indicated by solid lines 116,216,316,416,516, valve 16 in the wash water inlet 14 is opened and tank 100 is filled to the maximum level indicated by dotted line 118. This excess water is removed from tank 100 through outlet 118 as valve 122 is opened and pump 208 of the recirculation system 202 becomes connected to outlet 118. The excess water becomes part of the water in tank 200 and its recirculation system 202 and will trigger sensor 212 if the level in tank 200 exceeds the maximum level 218 thereby opening valve 222 and allowing water to pass into the recirculation system 302 of tank 300, etc.

The transfer process is repeated along the tanks until the tank which was originally too low has been brought back up to its normal operating level. For example, if the operating level in tank 300 was sensed as having fallen below the operating level, valve 16 is opened water is admitted into tank 100 filling that tank to the maximum level 118 as sensed by sensor 114. Having sensed that the water level in tank 100 has reached the maximum level 118, the solenoid valve 122 is opened under the control of the control means (not shown) and pump 208 of the recirculation system 202 for tank 200 removes the excess water from tank 100 through outlet 120.

This, in turn, will cause tank 200 to fill to its maximum level 218, and when this is sensed by level sensor 214, solenoid valve 222 is opened allowing pump 308 of recirculation system 302 to remove the excess water from tank 200 through outlet 220 and into tank 300. Once operating level sensor 312 in tank 300 senses that the water level is at the normal operating level 316, the valve 16 in wash water inlet 14 is closed off to stop the fill cycle.

When photographic material in web form is passing through a processor incorporating a washing stage 10 in accordance with the present invention, the amount of material is determined via a sensor (not shown) and water is fed into the washing stage 10 at a predetermined rate per unit area of material through wash water inlet 14 as controlled by valve 16. As previously described, the level sensor 114 in the tank 100 initially detects the rise in level of the wash water and operates the appropriate valves 122,222,322,422 to allow water to be moved through the washing stage by the pumps 208,308,408,508 of the respective recirculating systems 202,302,402,502 and through the tanks 200,300,400,500 against the direction of movement of material through the washing stage, that is, in the direction opposite to that indicated by arrow 12. The wash water eventually exits the washing stage 10 at wash water outlet 18 and is directed either to drain or to a cleaning system which allows the used wash water to be recycled.

As described previously, sensors 110,210,310,410,510 are positioned in the respective recirculation systems 102,202,302,402,502 to sense the conductivity of the wash water in each tank 100,200,300,400,500. Once a predetermined value of sensed conductivity has been sensed by any one of sensors 110,210,310,410,510, valve 16 in wash water inlet 14 is opened to admit fresh water to the washing stage 10. As described above, the wash water is cascaded through the tanks 200,300,400,500 due to the increase in water level in tank 100 until the conductivity of the water in each of the tanks is again within acceptable levels. Once all the sensors 110,210,310,410,510 sense conductivity levels which are acceptable, the valve 16 is closed shutting off the supply of fresh wash water to tank 100.

It is possible, under suitable conditions, to use sensors 110,210,310,410,510 to control entire washing stage 10 provided there is no product contamination resulting in variable stain on the washed photographic material. However, it is preferred that these sensors 110,210,310,410,510 are used as an "alarm" when the conductivity of the wash water reaches a predetermined limit It is to be understood that various other changes and modifications may be made without departing form the scope of the present invention, the present invention being limited by the following claims.

PARTS LIST

| | |
|---|---|
| 10 | washing stage |
| 12 | arrow |
| 14 | inlet |
| 16 | valve |
| 18 | wash water outlet |
| 100,200,300,400,500 | wash tanks |
| 102,202,302,402,502 | recirculation system |
| 104,204,304,404,504 | outlets |

-continued

PARTS LIST

| | |
|---|---|
| 106,206,306,406,506 | inlets |
| 108,208,308,408,508 | pump |
| 110,210,310,410,510 | sensors |
| 112,114,212,214,312,314,412,414,512 | level sensors |
| 116,216,316,416,516 | solid lines |
| 118,218,318,418,518 | dotted lines |
| 120,220,320,420 | outlets |
| 122,222,322,422 | solenoid operated valve |

What is claimed is:

1. A countercurrent multi-stage washing stage for photographic processing apparatus, the washing stage comprising:

a plurality of washing tanks having at least a first washing tank and a last washing tank with intermediate washing tanks located between the first and the last tanks, the first washing tank being upstream from the last and intermediate washing tanks, each washing tank having a recirculation system for circulating the washing solution therethrough;

an inlet through which fresh washing solution is added to the last tank of the washing stage;

an outlet from which washing solution is overflowed out of the first tank of the washing stage;

means for providing fluid connection between each washing tank and its adjacent upstream washing tank;

level sensing means for sensing a first level of washing solution in each of the washing tanks; and control means for receiving an output signal from the level sensing means for controlling the level of washing solution in each washing tank and also for controlling the recirculation system of each washing tank;

characterized in that the last and each intermediate washing tank further includes an outlet port therein, the outlet port being connectable to the recirculation system of an adjacent upstream washing tank via valve means, and further level sensing means for sensing a second level of washing solution which is greater than the first level and providing a control signal for the valve means via the control means when the second level has been sensed to reduce the level of the washing solution to the first level.

2. Apparatus according to claim 1 wherein each recirculating system includes a conductivity sensor for sensing the conductivity of the washing solution in that washing tank.

3. A method of controlling a countercurrent multi-tank washing stage comprising at least a first washing and a last washing tank with at least one intermediate washing tank therebetween, the first washing tank being upstream from the last and intermediate washing tanks, the method comprising the steps of:

a) controlling the recirculation of washing solution in each of the washing tanks;

b) sensing the conductivity of the washing solution in each of the processing tanks;

c) sensing the level of washing solution in each of the washing tanks;

d) replenishing the washing solution in the washing stage when the level of washing solution has dropped below a first level and/or the conductivity of the washing solution exceeds a predetermined limit in any one of the washing tanks;

characterized in that step d) further comprises the steps of:

e) adding fresh washing solution to the last washing tank until the washing solution reaches a second level, the second level being greater than the first level.

f) removing washing solution above the first level from the last washing tank and adding it to the recirculation system of an adjacent upstream intermediate tank until the washing solution in that tank reaches the second level.

g) repeating step f) for each intermediate tank until the first tank is filled to an overflowing level which is greater than the first level and the level of washing solution in every other washing tank is at the first level and the conductivity of the washing solution in each of the washing tanks below the predetermined limit.

* * * * *